US006904945B2

(12) United States Patent
Boillat et al.

(10) Patent No.: US 6,904,945 B2
(45) Date of Patent: Jun. 14, 2005

(54) MULTI-CHANNEL FLUID DISPENSER

(75) Inventors: Marc Boillat, Auvernier (CH); Bart Van Der Schoot, Neuchâtel (CH); Andreas Kuoni, Biel (CH); Roeland Papen, Half Moon Bay, CA (US); Nico De Rooij, Bôle (CH)

(73) Assignee: Seyonic SA, Neuchatel (CH)

( * ) Notice: Subject to any disclaimer, the term of this patent is extended or adjusted under 35 U.S.C. 154(b) by 0 days.

(21) Appl. No.: 10/481,952

(22) PCT Filed: Jun. 28, 2002

(86) PCT No.: PCT/CH02/00353

§ 371 (c)(1),
(2), (4) Date: Jul. 7, 2004

(87) PCT Pub. No.: WO03/004163

PCT Pub. Date: Jan. 16, 2003

(65) Prior Publication Data

US 2004/0238064 A1 Dec. 2, 2004

(30) Foreign Application Priority Data

Jul. 5, 2001 (EP) ..... 01810661

(51) Int. Cl.[7] ..... B65B 1/04
(52) U.S. Cl. ..... 141/130; 239/102.2; 141/302
(58) Field of Search ..... 141/130, 67, 301, 141/302; 239/102.1, 102; 422/99, 100

(56) References Cited

U.S. PATENT DOCUMENTS 4,058,146 A 11/1977 Citrin ..... 141/1
4,621,665 A 11/1986 Webb ..... 141/1
5,518,179 A * 5/1996 Humberstone et al. .. 239/102.2
6,318,640 B1 * 11/2001 Coffee ..... 239/3

FOREIGN PATENT DOCUMENTS

EP 0 955 084 A1 11/1999 ..... B01J/19/00
WO WO 98/29736 7/1998 ..... G01N/25/20

OTHER PUBLICATIONS

Blanchard, A.P. et al. "High–Density Oligonucleotides Arrays" *Biosensors & Bioelectronics* 11:6/7:686–690; 1996.
Lander, E.S. "Array of Hope" *Nature Genetics Supplement* 21: Jan. 1999.

* cited by examiner

*Primary Examiner*—Steven O. Douglas

(57) ABSTRACT

The invention relates to a multi-duct fluid dispenser for withdrawing liquid (14) from a plurality of cavities (12) formed in a reservoir platter (10) and spraying it onto a receiving platter (16). It comprises:

a plurality of flexible ducts (26) arranged in a convergent bundle, the first ends of which are intended to be immersed in said cavities and the second ends of which are assembled in a miniaturized array, means of filling said ducts, from their first ends, with the liquid contained in the cavities, and means of expelling a drop of liquid from the second end of each duct toward the receiving platter.

The ducts are formed in a plurality of flexible plates (18) joined together by their part (24) that comprises the second ends of the ducts. They are each formed of two polymer sheets (34, 36) sealed together and of which at least one is endowed with an array of convergent grooves forming the ducts.

14 Claims, 2 Drawing Sheets

MULTI-CHANNEL FLUID DISPENSER

The present invention relates to the production of miniaturized high-density arrays of samples of biological substances (oligonucleotides, DNA, etc), often known as "biochips", so that they can be treated.

Such arrays are tools that are particularly useful in the field of molecular biology, as borne out, in particular, by the publications "High-density oligonucleotides arrays" (A. P. Blanchard et Al. —Biosensors & Biolectronics, Vol. 11, No. 6/7, pp. 686–690, 1996) and "Array of hope" (E. S. Lander—Nature Genetics Supplement, Vol. 21, January 1999).

The invention relates more specifically to a multi-duct fluid dispenser making it possible to withdraw liquid from a plurality of cavities formed in a reservoir platter then to deposit an array of microdrops thereof on to a receiving platter as to constitute a "biochip".

The dispenser according to the invention is of the type comprising:

- a plurality of flexible ducts arranged in a convergent bundle, the first ends of which are intended to be immersed in the cavities of the reservoir platter and the second ends of which are assembled in a miniaturized array,
- means of filling the ducts, from their first ends, with the liquid contained in the cavities, and
- means of expelling a drop of liquid from the second end of each duct toward the receiving platter.

A device of this type is described in document WO 98/29736. The ducts are formed of a bundle of capillary filaments gathered together onto an impression head. They are all controlled together.

Documents U.S. Pat. No. 4,058,146 and EP 0 955 084 propose similar embodiments, but the expulsion of liquid is therefore done by simple contact with the receiving platter. The same is true of the device described in document U.S. Pat. No. 4,621,665 but, in this case, there is no change in format between the reservoir platter and the receiving platter.

The present invention aims to provide a dispenser that constitutes an improved version of the aforementioned systems of the prior art.

In order to achieve this objective, this dispenser according to the invention is characterized in that:

- the ducts are formed in a plurality of flexible plates so as to converge from their first ends toward their second ends;
- these plates are joined together by their part that comprises the second ends of the ducts;
- each plate comprises two polymer sheets sealed together and of which at least one is endowed with an array of convergent grooves forming the ducts,
- each duct has a first narrowing near its second end and a second narrowing at said end; and
- said expelling means comprise a piezoelectric actuator arranged on an exterior wall of the duct, between its two narrowings, and the purpose of which is to deform said at this point so as to reduce the thickness of the duct.

Advantageously, the dispenser according to the invention also has the following main characteristics.

- The reservoir platter is sealed closed by a lid through which the ducts pass and the filling means are arranged in such a way as to raise the pressure in the space lying between the lid and the cavities.

- The filling means comprise a bellows connecting the lid and its platter at their periphery.
- The expelling means comprise a second piezoelectric actuator identical to the first one and arranged facing it on the other exterior wall of the duct.
- The piezoelectric actuator is formed as a stack which comprises, starting from the exterior wall of the duct, a lower metal electrode, an insulating layer, a layer of piezoelectric material, a further insulating layer and an upper metal electrode.
- The expelling means are designed in such a way as to be able to act on each duct individually.

Other characteristics of the invention will become apparent from the description which follows, given with reference to the attached drawing in which.

Figure 1:
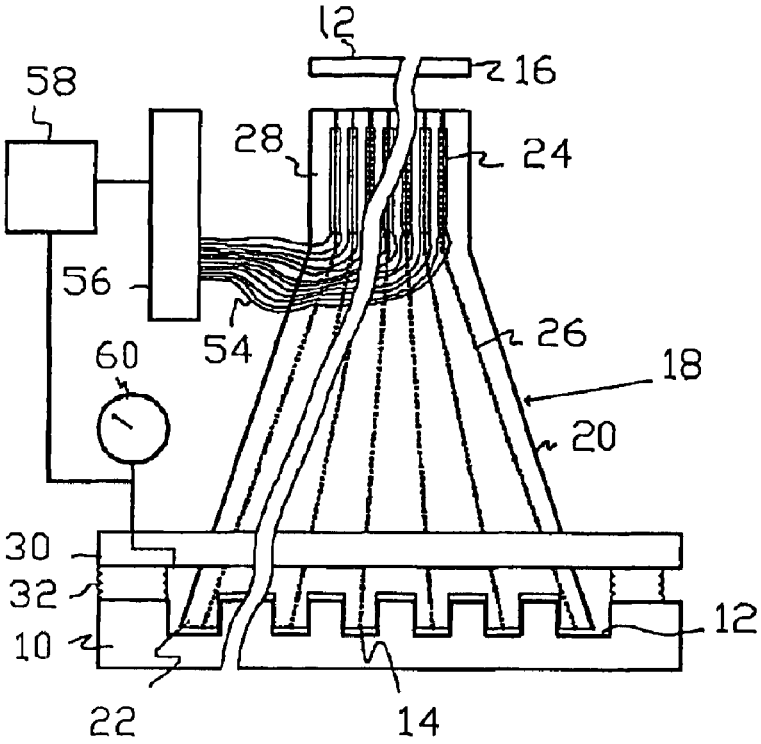
FIGS. 1 and 2 depict, viewed from the front and from the side respectively, a dispenser according to the invention.
Figure 2:
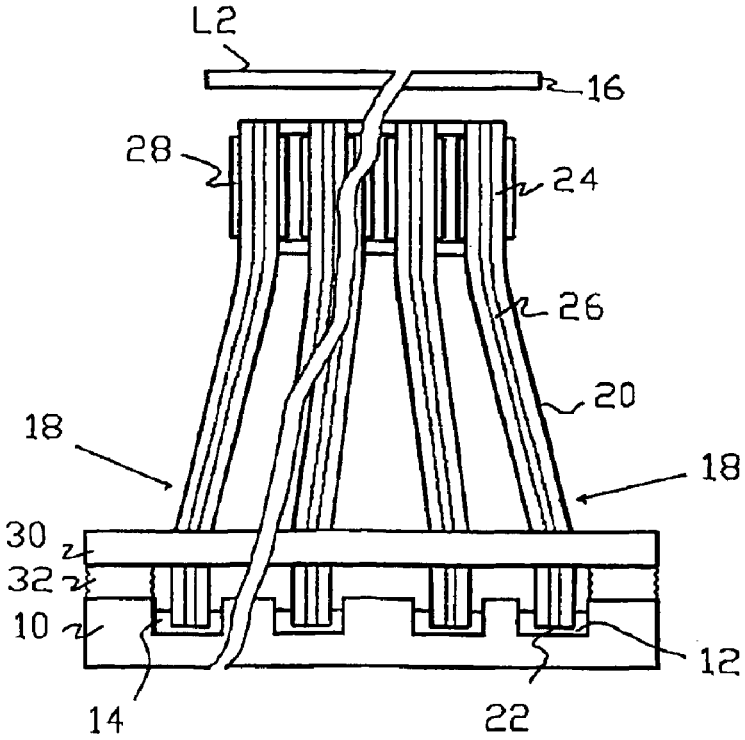

FIGS. 1 and 2 show at 10 a reservoir platter, made of glass or rigid plastic, provided with a plurality of cavities 12 arranged in a two-dimensional array, in each of which cavities there is a biological liquid 14 samples of which need to be deposited, in the form of microdrops, onto a miniaturized receiving platter 16, also made of glass or rigid plastic (nylon).

Figure 3:
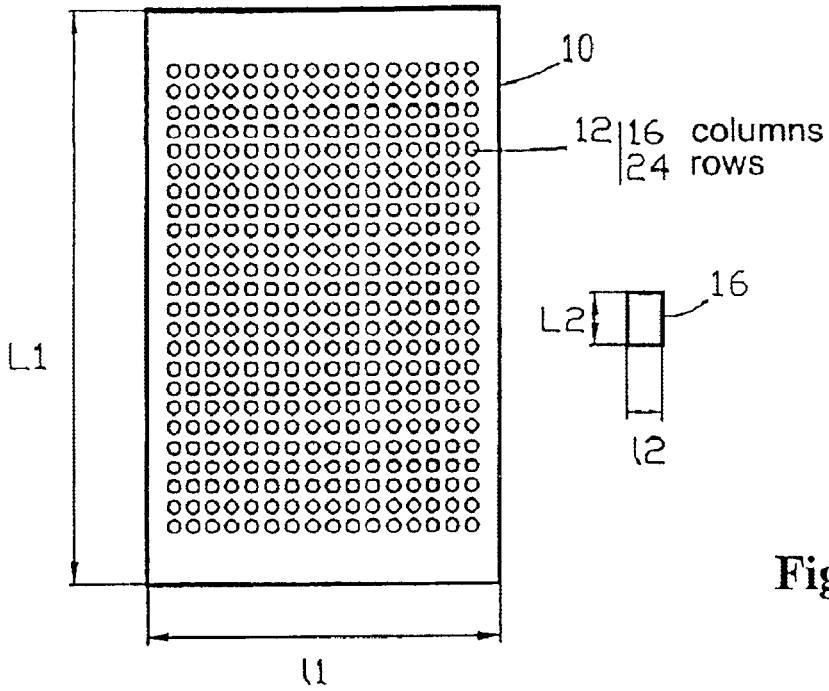
FIG. 3 shows, arranged side by side and to scale, a reservoir platter and a receiving platter.

It will immediately be seen on referring to FIG. 3 because, for obvious reasons, this is not visible in FIGS. 1 and 2, that the two platters are of very different sizes. Typically, the reservoir platter 10 has a surface area of about 100 $cm^2$ (12.5 cm×8.5 cm) and has 384 cavities 12, of a volume of around 100 $\mu$l, arranged in a two-dimensional array of 16 columns of 24 rows and about 4.5 mm apart, between centers. By contrast, the receiving platter 16 does not have cavities and has a surface area of about 1 $cm^2$ only (1.2 cm×0.8 cm).

In order to withdraw liquid contained in the cavities 12 and spray an array of microdrops thereof onto the receiving platter 16, the device according to the invention has a plurality of flexible transfer plates 18 joined together. These plates are made of polyimide, for example, and have a thickness of the order of 50 to 150 $\mu$m.

Each plate 18 has a lower part in the form of an isosceles trapezium 20, forming a fluid interface, the long base of which is roughly the same length as the width $I_1$ of the reservoir platter 10 and is crenellated in such a way as to end in as many end portions 22 as the reservoir platter has columns of cavities 12, namely 16 in the example described. The crenellations are sized in such a way that the portions 22 can enter the cavities 12.

The trapezium-shaped fluid interface 20 is extended, from its short base, via a rectangular part 24 the length of which corresponds roughly to the width $I_2$ of the receiving platter 16.

Each flexible plate 18 is provided with a bundle of ducts 26 which originate in each of its end portions 22 and terminate, parallel to one another, in the upper part 24. Typically, in the exemplary embodiment described, the ducts 26 are then 0.5 mm apart, between centers.

The device according to the invention has as many identical plates 18 as the reservoir platter 10 has rows, namely 24 in the example described, the end portions 22 of each plate being intended to fit in one of the columns of the platter.

The flexible plates 18 are gathered together, at their upper part, parallel to one another, into a frame 28 to form an impression head the length of which roughly corresponds to the length $L_2$ of the receiving platter 16 and the width of which, as already mentioned, roughly corresponds to its width $I_2$.

It goes without saying that the plates could also have a base of a length that corresponds to the length $L_1$ of the reservoir platter 10.

As FIGS. 1 and 2 show, the reservoir platter 10 is sealed closed by a lid 30 through which the flexible plates 18 pass, also with sealing. The sealing around the periphery is provided by a bellows 32, the purpose of which will become apparent later on.

Figure 4:
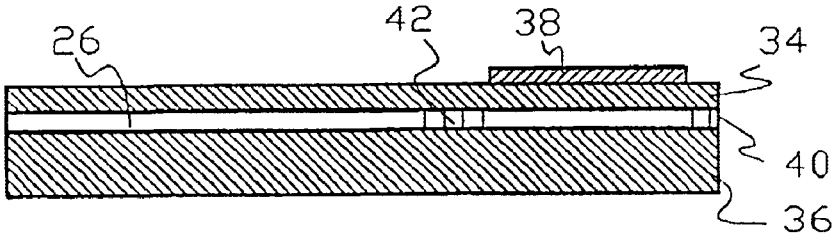
FIG. 4 is a view in section of a duct.

Reference will now be made to FIG. 4 which shows, on a larger scale, the way in which the flexible plates 18 and their ducts 26 are made. It can be seen that these plates are formed of two thin sheets of plastic 34 and 36 of which one, the upper sheet 34 in the figure, has been pre-scored, by any method well known to those skilled in the art, to define the outline of the ducts 26 and which are then joined together with a laminating process, also well known to those skilled in the art.

Typically, the sheets 34 and 36 have a thickness of 25 to 50 $\mu$m and the total volume of the ducts is about 0.5 to 3 $\mu$l.

In their rectangular part 24, the plates 18 comprise, fixed to their upper sheet 34, facing each duct 26, a piezoelectric actuator 38 whose purpose is to deform the sheet at this point so as to reduce the thickness of the duct.

Above the actuator 38, the duct 26 opens to the outside of the sheet via a narrowing that forms the spout 40, whereas, on the other side, the duct has a narrowing 42. In the example described, the spout 40 and the narrowing 42 have the same depth, from 10 to 40 $\mu$m, and the same width, from 40 to 90 $\mu$m. The dimensions of the narrowing may even be smaller than those of the spout.

Figure 5:
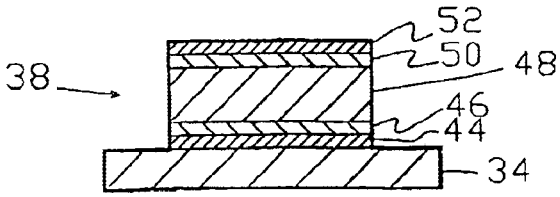
FIG. 5 shows, in section, the structure of the actuator associated with each duct.

FIG. 5 shows that the actuator 38 is formed of a stack which comprises, starting from the sheet 34, a lower metal electrode 44, an insulating layer 46, a layer of piezoelectric material 48, a further insulating layer 50 and an upper metal electrode 52. The two electrodes are associated with electrical conductors 54 for controlling the actuator.

The electrodes 44 and 52 are deposited by evaporation, while the insulating layers 46 and 50 are deposited by plasma and the piezoelectric layer 48 is deposited by magnetron-enhanced vapor deposition.

As depicted in FIG. 1, the electrical conductors powering the various actuators 38 end at a control circuit 56 which, under the command of a computer 58, energizes them.

In operation, the assembly formed by the assembled transfer plates 18 is placed above the reservoir platter 10 whose cavities 12 contain the liquids 14 that are to be transferred onto the receiving platter 16. Alignment is performed in such a way that having passed through the lid 30, each of the end portions 22 of the transfer plates 18 lies vertically above a cavity 12. When the ends of the plates are immersed in the liquid, this liquid is drawn up into the various ducts 26 through a capillary effect.

It is then necessary to press on the lid 30 in order to compress the bellows 32 so as to raise the pressure in the chamber by a few millibar, the pressure being read off a pressure gauge 60. Because of this rise in pressure, the liquid continues to rise up inside the ducts 26, passes through the narrowings 42, and comes to a halt at the spouts 40, through a surface tension effect.

In order to eject the liquid toward the receiving platter 16, all that is then required is for the computer 58 to be commanded to apply to the terminals of the electrodes 44 and 52 of each actuator 38 an electrical impulse that causes narrowing of the corresponding duct 26. Some of the liquid contained therein, prevented from flowing back by the narrowing 42, is thus ejected through the spout 40 and sprayed on to the receiving platter 16, at a clearly defined point.

The receiving platter 16 can thus receive an array of microdrops of liquid formed at the same number of rows and columns as the reservoir platter but, as already mentioned, at a greatly reduced scale. Typically, in the example described, the microdrops may have a volume from 20 pl to 1 nl.

Since the plates 18 contain a volume of liquid far greater than that of the ejected microdrops, several receiving platters 16 can then be used one after another.

In an alternative form of embodiment that has not been depicted, the ducts 26 could be subjected to the effect of two identical actuators 38 arranged face to face on the outside of each of the sheets that form the flexible plates. Such an arrangement allows better control over the direction in which the drops are ejected.

This description has been given with reference to a flexible plate formed of two sheets sealed together. As an alternative, the plates could be formed of three sheets, the central sheet of which would be pierced with through-openings forming the ducts.

There is thus produced a liquid dispenser that has the following main advantages:

- because the impression head 24 and the fluid interface 20 are combined as a single piece, the plates 18, the path of the liquid is perfectly uniform and only a minimum amount of dead volume remains;
- because the plates 18 are flexible, it is easier to adapt the device to suit reservoir platters 10 and receiving platters 16 of different sizes;
- because the flexible plates 18 are formed of two polymer sheets assembled by lamination rather than bonding, any contamination with adhesive of the liquids flowing through the ducts is eliminated;
- because each duct 26 can be controlled individually by an impulse that ejects a single microdrop, the uniformity in terms of volume of the microdrops can be guaranteed.

What is claimed is:

1. A multi-duct fluid dispenser for withdrawing liquid (14) from a plurality of cavities (12) formed in a reservoir platter (10) and spraying it onto a receiving platter (16), comprising:

- a plurality of flexible ducts (26) arranged in a convergent bundle, the first ends of which are intended to be immersed in said cavities and the second ends of which are assembled in a miniaturized array,
- means of filling said ducts, from their first ends, with the liquid contained in the cavities, and
- means of expelling a drop of liquid from the second end of each duct toward the receiving platter, characterized in that:
- said ducts (26) are formed in a plurality of flexible plates (18) so as to converge from their first ends toward their second ends;
- said plates (18) are joined together by their part (24) that comprises the second ends of the ducts,
- each plate comprises two polymer sheets (34, 36) sealed together and of which at least one is endowed with an array of convergent grooves forming said ducts;
- each duct (26) has a first narrowing (42) near its second end and a second narrowing (40) at said end; and said expelling means comprise a piezoelectric actuator (38) arranged on an exterior wall of the duct, between its two narrowings, and the purpose of which is to deform said wall at this point so as to reduce the thickness of the duct.

2. The dispenser of claim 1, characterized in that the reservoir platter (10) is sealed closed by a lid (30) through which the ducts pass and in that said filling means are arranged in such a way as to raise the pressure in the space lying between the lid and the cavities.

3. The dispenser of claim 2, characterized in that said filling means comprise a bellows (32) connecting the lid (30) and its platter (10) at their periphery.

4. The dispenser of claim 1, characterized in that said expelling means comprise a second piezoelectric actuator (38) identical to the first one and arranged facing it on the other exterior wall of the duct.

5. The dispenser of claim 1, characterized in that said actuator is formed as a stack which comprises, starting from the exterior wall of the duct, a lower metal electrode (44), an insulating layer (46), a block of piezoelectric material (48), a further insulating layer (50) and an upper metal electrode (52).

6. The dispenser of claim 1, characterized in that said expelling means (38) are designed in such a way as to be able to act on each duct individually.

7. The dispenser of claim 2, characterized in that said actuator is formed as a stack which comprises, starting from the exterior wall of the duct, a lower metal electrode (44), an insulating layer (46), a block of piezoelectric material (48), a further insulating layer (50) and an upper metal electrode (52).

8. The dispenser of claim 3, characterized in that said actuator is formed as a stack which comprises, starting from the exterior wall of the duct, a lower metal electrode (44), an insulating layer (46), a block of piezoelectric material (48), a further insulating layer (50) and an upper metal electrode (52).

9. The dispenser of claim 4, characterized in that said actuator is formed as a stack which comprises, starting from the exterior wall of the duct, a lower metal electrode (44), an insulating layer (46), a block of piezoelectric material (48), a further insulating layer (50) and an upper metal electrode (52).

10. The dispenser of claim 4, characterized in that said expelling means (38) are designed in such a way as to be able to act on each duct individually.

11. The dispenser of claim 5, characterized in that said expelling means (38) are designed in such a way as to be able to act on each duct individually.

12. The dispenser of claim 7, characterized in that said expelling means (38) are designed in such a way as to be able to act on each duct individually.

13. The dispenser of claim 8, characterized in that said expelling means (38) are designed in such a way as to be able to act on each duct individually.

14. The dispenser of claim 9, characterized in that said expelling means (38) are designed in such a way as to be able to act on each duct individually.

* * * * *